US006971762B2

(12) United States Patent
Galli

(10) Patent No.: US 6,971,762 B2
(45) Date of Patent: Dec. 6, 2005

(54) DUAL MODE SWITCH MECHANISM FOR FLASHLIGHTS

(76) Inventor: Robert Galli, 8176 Horseshoe Bend La., Las Vegas, NV (US) 89113

( * ) Notice: Subject to any disclaimer, the term of this patent is extended or adjusted under 35 U.S.C. 154(b) by 187 days.

(21) Appl. No.: 10/356,274

(22) Filed: Jan. 31, 2003

(65) Prior Publication Data

US 2003/0147239 A1 Aug. 7, 2003

Related U.S. Application Data

(60) Provisional application No. 60/353,367, filed on Feb. 1, 2002.

(51) Int. Cl.[7] ..... F21L 4/00

(52) U.S. Cl. ..... 362/206; 362/205; 362/203; 362/188; 200/60

(58) Field of Search ..... 362/205, 203, 362/188, 206; 439/233; 200/60

(56) References Cited

U.S. PATENT DOCUMENTS

| | | | | |
|---|---|---|---|---|
| 762,720 | A | 6/1904 | Hubert | |
| 1,047,525 | A | 12/1912 | Hubert | |
| 1,436,340 | A | 11/1922 | Gallagher | |
| 1,866,600 | A | 7/1932 | Rauch | |
| 2,249,692 | A | 7/1941 | Gelardin | |
| 2,412,056 | A | 12/1946 | Mosch | |
| 2,465,114 | A | 3/1949 | Oury | |
| 2,591,112 | A | 4/1952 | Zwierzynski | |
| 2,709,073 | A | 5/1955 | Mohylowski | |
| 2,714,152 | A | 7/1955 | Ackerman et al. | 562/116 |
| 2,762,907 | A | 9/1956 | Schwartz | |
| 2,889,450 | A | 6/1959 | Nordquist et al. | |
| 3,057,992 | A | 10/1962 | Baker | |
| 3,085,149 | A | 4/1963 | Giwosky | |
| 3,085,150 | A | 4/1963 | Bautsch | |
| 3,119,564 | A | 1/1964 | Zalman | |
| 3,256,428 | A | 6/1966 | Schwartz | |
| 3,296,429 | A | 1/1967 | Schwartz | |
| 3,310,668 | A | 3/1967 | Schwartz | |
| 3,345,508 | A | 10/1967 | Chung | |
| 3,359,411 | A | 12/1967 | Schwartz | |
| 3,613,414 | A | 10/1971 | Ostranger | |
| 3,732,414 | A | 5/1973 | Franc | 240/10.61 |
| 3,804,307 | A | 4/1974 | Johnston | 224/28 |
| 3,866,035 | A | 2/1975 | Richey, Jr. | 240/6.4 |

(Continued)

OTHER PUBLICATIONS

Photon Micro-Light II and Hiyoshi Frosted-LEd Lamp, 2001 PhotonLight.

(Continued)

*Primary Examiner*—Sandra O'Shea
*Assistant Examiner*—Anabel Ton
(74) *Attorney, Agent, or Firm*—Barlow, Josephs & Holmes, Ltd.

(57) ABSTRACT

The present invention provides a unique dual mode, inline switch mechanism that is fully integrated into the rear cap of a flashlight assembly to provide a completely self contained and waterproof switching mechanism. The switch assembly further provides dual mode functionality including an ON position and a momentary ON position while also including a reliable OFF position that prevents the accidental activation of the light when the user desires that it remain off. The entire mechanism resides in the end cap of the flashlight assembly and includes an end cap structure that is designed to be rotatably attached to the end of a flashlight housing, a contact plate, a plunger, an insulator disk and an elastomeric cover. The switch mechanism is fully integrated on the interior of the flashlight providing the highly desirable, fully contained, in line functionality.

12 Claims, 6 Drawing Sheets

U.S. PATENT DOCUMENTS

| | | | | |
|---|---|---|---|---|
| 3,870,843 | A | 3/1975 | Witte | 200/302 |
| 4,076,976 | A | 2/1978 | Fenton | 362/104 |
| 4,085,315 | A | 4/1978 | Wolter et al. | 362/116 |
| 4,101,955 | A | 7/1978 | DuNah | 362/104 |
| 4,122,510 | A | 10/1978 | Halliday, Jr. | 362/189 |
| 4,129,899 | A | 12/1978 | Dunbar | 362/109 |
| 4,210,953 | A | 7/1980 | Stone | 362/189 |
| 4,228,484 | A | 10/1980 | Johnstone | 362/184 |
| 4,261,026 | A | 4/1981 | Bolha | 362/101 |
| 4,276,582 | A | 6/1981 | Burnett | 362/116 |
| 4,303,966 | A | 12/1981 | Wolter | 362/116 |
| 4,336,574 | A | 6/1982 | Goodman | 362/101 |
| 4,346,329 | A | 8/1982 | Schmidt | 315/51 |
| 4,392,186 | A | 7/1983 | Cziment | 362/116 |
| 4,398,237 | A | 8/1983 | Doyel | 362/186 |
| 4,399,495 | A | 8/1983 | Leopoldi et al. | 362/189 |
| 4,408,261 | A | 10/1983 | Polakoff | 362/104 |
| 4,422,131 | A | 12/1983 | Clanton et al. | 362/186 |
| 4,433,365 | A | 2/1984 | Rousseau | 362/189 |
| 4,517,627 | A | 5/1985 | Bradford | 362/156 |
| 4,521,833 | A | 6/1985 | Wolter | 362/116 |
| 4,524,409 | A | 6/1985 | Yakubek | |
| D285,989 | S | 10/1986 | MacDonald | |
| 4,628,418 | A | 12/1986 | Chabria | |
| D290,518 | S | 6/1987 | Rakocy et al. | |
| 4,731,712 | A | 3/1988 | Amthor | 362/189 |
| 4,768,138 | A | 8/1988 | Leopoldi et al. | 362/189 |
| 4,787,016 | A | 11/1988 | Song | |
| 4,823,242 | A * | 4/1989 | Maglica et al. | 362/187 |
| 4,893,222 | A | 1/1990 | Mintzer | 362/109 |
| D311,067 | S | 10/1990 | Chabria | |
| 5,008,784 | A | 4/1991 | Wang | 362/116 |
| 5,029,055 | A | 7/1991 | Lindh | 362/191 |
| 5,043,854 | A | 8/1991 | Gammache | 362/197 |
| 5,122,943 | A | 6/1992 | Pugh | |
| 5,143,442 | A | 9/1992 | Ishikawa et al. | |
| 5,158,356 | A | 10/1992 | Guthrie | 362/188 |
| D337,200 | S | 7/1993 | Keller | |
| 5,285,586 | A | 2/1994 | Goldston et al. | 36/137 |
| 5,318,177 | A | 6/1994 | Isacson | |
| 5,386,351 | A | 1/1995 | Tabor | 362/201 |
| 5,457,613 | A | 10/1995 | Vandenbelt et al. | 362/200 |
| 5,463,539 | A | 10/1995 | Vandenbelt et al. | |
| 5,465,197 | A | 11/1995 | Chien | 362/203 |
| 5,475,368 | A | 12/1995 | Collins | 340/573 |
| 5,515,248 | A | 5/1996 | Canfield et al. | |
| 5,541,817 | A | 7/1996 | Hung | 362/116 |
| D372,356 | S | 8/1996 | Marguerite | |
| 5,642,932 | A | 7/1997 | Matthews | |
| D381,803 | S | 8/1997 | Crego | D3/208 |
| 5,730,013 | A | 3/1998 | Huang | |
| D394,345 | S | 5/1998 | Marguerie | |
| D400,326 | S | 10/1998 | Fisher | D32/42 |
| D401,371 | S | 11/1998 | Chen | |
| D402,069 | S | 12/1998 | Chan | |
| 5,893,631 | A | 4/1999 | Padden | 362/201 |
| 5,894,196 | A | 4/1999 | McDermott | 313/512 |
| 5,927,846 | A | 7/1999 | Sinclair | |
| 5,934,789 | A | 8/1999 | Sinclair et al. | |
| 5,956,985 | A | 9/1999 | Chang | 70/456 |
| 6,006,562 | A | 12/1999 | Wolter | |
| 6,039,454 | A | 3/2000 | Hallgrimsson | |
| 6,046,572 | A | 4/2000 | Matthews et al. | |
| 6,070,990 | A | 6/2000 | Dalton et al. | |
| 6,079,845 | A | 6/2000 | Kreider | |
| 6,109,762 | A | 8/2000 | Hallgrimsson et al. | 362/200 |
| 6,164,795 | A | 12/2000 | Lopez | 362/116 |
| 6,190,018 | B1 | 2/2001 | Parsons et al. | 362/116 |
| 6,222,138 | B1 | 4/2001 | Matthews et al. | |
| 6,527,419 | B1 | 3/2003 | Galli | |
| 6,530,672 | B2 | 3/2003 | Galli | |
| 2002/0109987 | A1 * | 8/2002 | Lai | 362/206 |

OTHER PUBLICATIONS

National Electrical Manufacturers Association: ANSI C79.1-1994,American National Standard.

Norme Internationale-International Standard—CEI iEC 60983, Second Edition Feb. 1995 Miniature lamps.

* cited by examiner

DUAL MODE SWITCH MECHANISM FOR FLASHLIGHTS

CROSS-REFERENCE TO RELATED APPLICATIONS

This application is related to and claims priority from earlier filed provisional patent application No. 60/353,367, filed Feb. 1, 2002.

BACKGROUND OF THE INVENTION

The present invention relates generally to a dual mode switch for improved functioning in flashlight devices. More specifically, the present invention relates to an improved pushbutton switching mechanism for flashlights that provides a momentary and constant ON feature as well as a positive, reliable OFF position.

Flashlights of varying sizes and shapes are generally well known in the art. A number of such designs are known that utilize two or more batteries as their source for electrical energy. Typically, these batteries are carried in series in a tubular body, where the tubular body also serves as a handle for the flashlight. In order to operate the flashlight, an electrical circuit is established from one terminal of the battery, through a conductor to an external switch located in an opening in the side of the tubular body and then through another conductor to one contact of a bulb. After passing through the filament of the bulb, the electrical circuit emerges through a second contact of the bulb in electrical contact with a conductor, which in turn is in electrical contact with the flashlight housing. Finally, the flashlight housing provides an electrically conductive path to the other terminal at the rear of the battery. Actuation of the external switch completes the electrical circuit selectively enabling electrical current to pass through the filament of the bulb, thereby generating light that is then typically focused by a reflector to form a beam of light.

In general, the above described flashlight switch mechanisms operate in two basic manners. The first method of operation is a pushbutton type switch on the side or bottom of the light. The user depresses the switch, which has an internal mechanism that locks in the engaged position, turning the flashlight on. To turn the light off, the user again depresses the switch, unlocking it and turning the light off. This design has several drawbacks. One drawback is that the increased number of parts creates additional assembly steps and increases the difficulty of assembly process. Another drawback is that when a flashlight of this type is stored in luggage, it is susceptible to being compressed by items that may shift during transit, thereby activating the flashlight and draining the battery. A further drawback associated with this possibility of accidental activation is evident in high intensity flashlights that generate a great deal of heat during operation. If a flashlight of this type is tightly packed in luggage and accidentally activated, it may cause a fire.

In an attempt to resolve the drawbacks noted above, with respect to the push-button type switches, a second type of rotatable switch was developed for in-line use in flashlights. In one design, an end cap is rotatably secured to the flashlight body. To establish the required electrical contact, the end cap is rotated making contact between the rear contact of the batteries and the housing of the flashlight thereby energizing the circuit and illuminating the lamp bulb. A number of such prior art designs feature rotatable end caps which are rotated to move the batteries longitudinally within the flashlight body towards the lamp bulb, thereby causing contact between the battery contact and the base contact of the lamp bulb. In the open position, the battery is typically spring biased away from the base contact of the bulb. In other designs, miniature flashlights have been designed where the rotatable switch is located in the reflector end of the flashlight body. The lamp bulb is located within an insulated receptacle at the reflector end of the flashlight with one or more conductive pins being rotatably aligned by movement of the switch portion of the device to establish electrical contact. While these switch mechanisms are internal to the device and thus less subject to damage, they are overly complicated in design thereby requiring higher assembly tolerances, which result in making them more costly to manufacture.

There is therefore a need for a unique flashlight switching design that provides dual mode functionality with a reliable OFF position that has improved functionality over the designs of the prior art. There is a further need for a flashlight switch device that requires a reduced number of parts thereby simplifying assembly and manufacture while providing the necessary dual mode functionality described above.

BRIEF SUMMARY OF THE INVENTION

In this regard, and in furtherance of the above stated objectives, the present invention provides a unique dual mode, inline switch mechanism that is fully integrated into the rear cap of a flashlight assembly to provide a completely self contained and waterproof switching mechanism. The switch assembly further provides a reliable OFF position that prevents the accidental activation of the light when the user desires that it remain off.

The entire basic structure of the switch of the present invention resides in the end cap of the flashlight assembly and includes an end cap structure that is designed to be rotatably attached to the end of a flashlight housing, a contact plate, a plunger, an insulator disk and an elastomeric cover. Only the contact plate in the assembly of the present invention is required to be conductive. The end cap structure may be conductive so that its material is consistent with the material used in the outer housing of the flashlight however this is not required. The remaining components however are all electrically insulative and designed to properly isolate the conductive components to insure proper operation of the switch assembly. The plunger and contact plate are assembled and supported in an opening in the insulator disk. The insulator disk is then further assembled into the end cap. This provides for the plunger and contact plate to be located in a position at the rear of the flashlight where its motion is limited to a controlled and predictable linear travel. As can be seen, in this manner a switch assembly that operates in an in-line fashion is provided.

By limiting the travel of the plunger and contact plate to a predictable distance, the present invention can achieve the desired multifunctionality, namely, a momentary ON function, a full ON function and a verifiable OFF function. Each one of the functions is selected by rotating the end cap assembly including the switch of the present invention. As the end cap of the assembly is rotated, its linear spacing relative to the flashlight housing is increased or decreased thereby altering the mode of switch operation. In this manner an economical flashlight assembly is provided that has a reduced number of operational parts as compared to the prior art thereby producing a more reliable product.

Accordingly, one of the objects of the present invention is the provision of a low cost flashlight having a superior dual mode switching mechanism. Another object of the present invention is the provision of a flashlight having a dual mode switching mechanism that includes a momentary ON, a full ON and a verifiable OFF position. A further object of the present invention is the provision of a flashlight having a dual mode switch that includes a reduced number of moving components thereby reducing manufacturing and assembly costs while improving the reliability of the assembly. Yet a further object of the present invention is the provision of a flashlight assembly having a dual mode switch that is integrated in an inline fashion and is waterproof.

Other objects, features and advantages of the invention shall become apparent as the description thereof proceeds when considered in connection with the accompanying illustrative drawings.

BRIEF DESCRIPTION OF THE DRAWINGS

In the drawings which illustrate the best mode presently contemplated for carrying out the present invention.

DETAILED DESCRIPTION OF THE INVENTION

Figure 1:
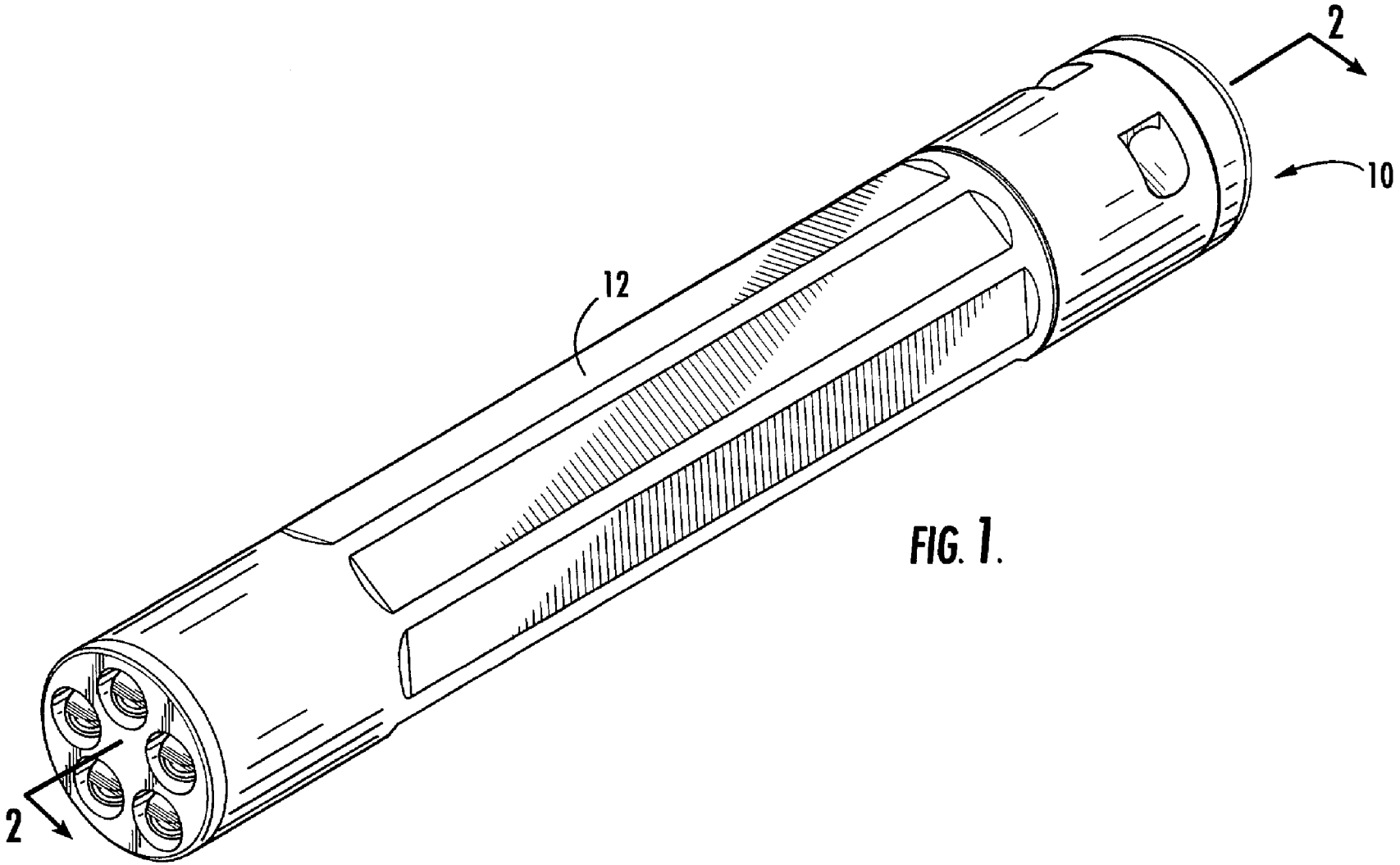
FIG. 1 is a perspective view of a flashlight employing the dual mode switch assembly of the present invention.
Figure 2:
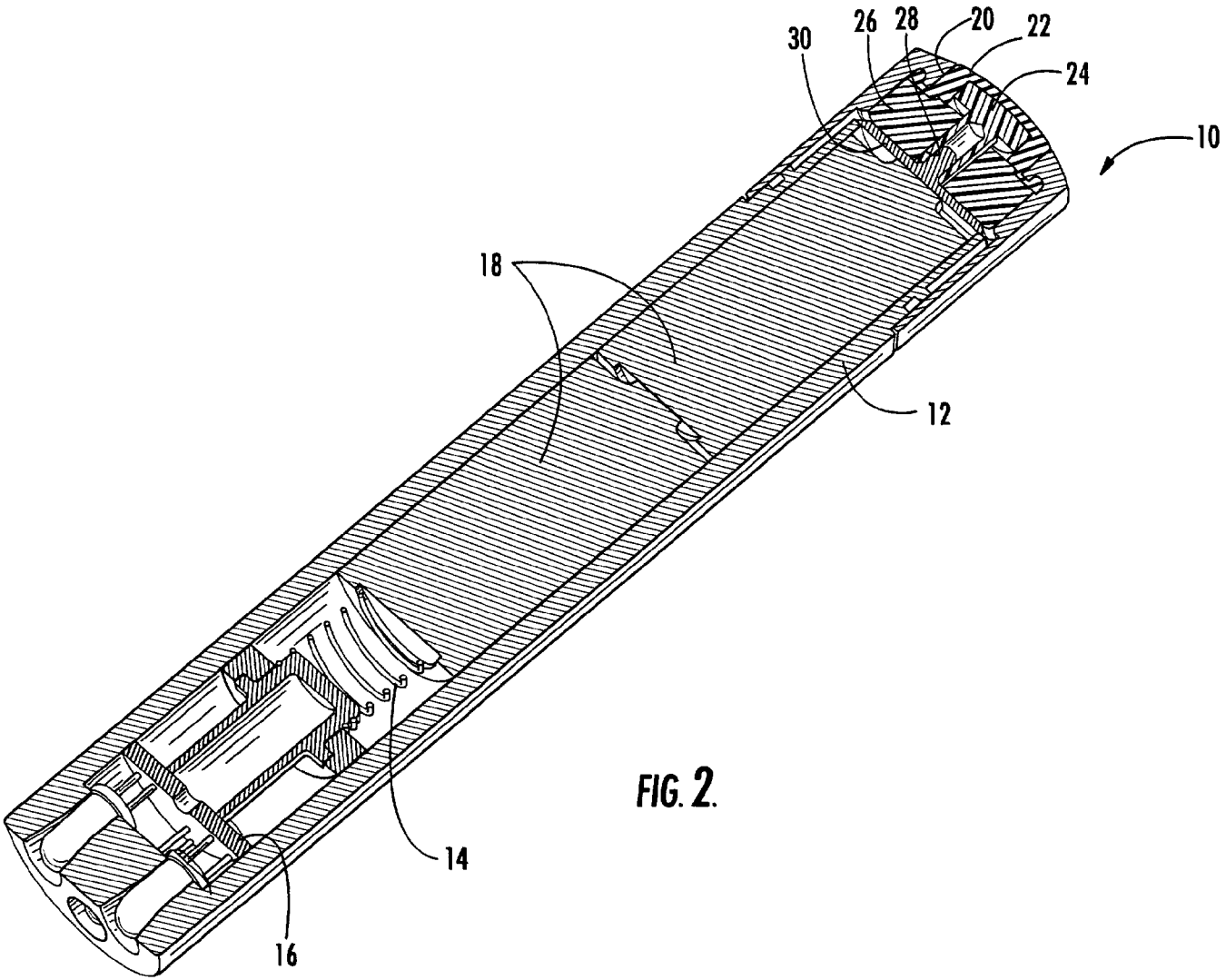
FIG. 2 is a cross-sectional view thereof taken along Line 2—2 of FIG. 1.
Figure 3:
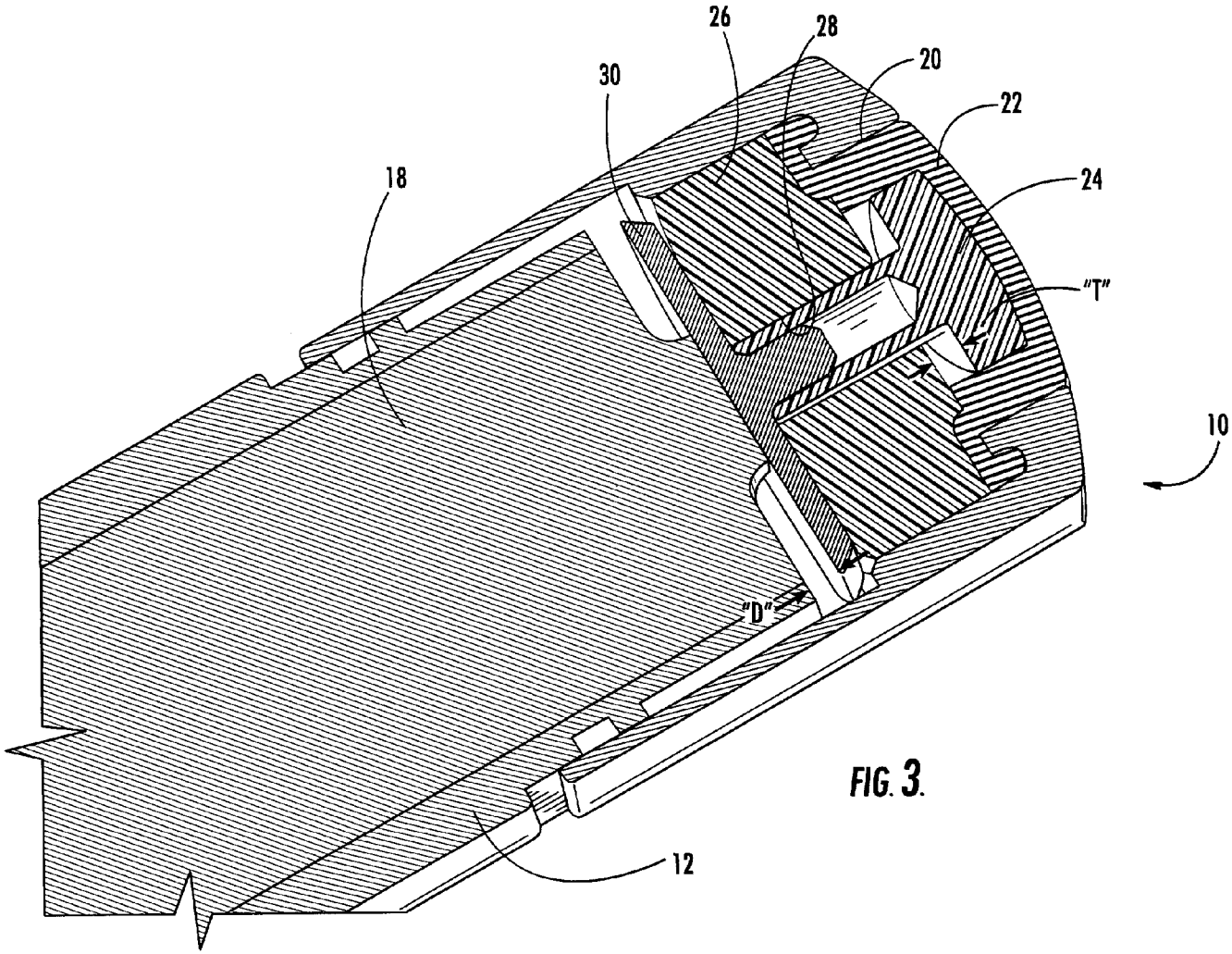
FIG. 3 is an enlarged cross-sectional view thereof in the OFF position.
Figure 4:
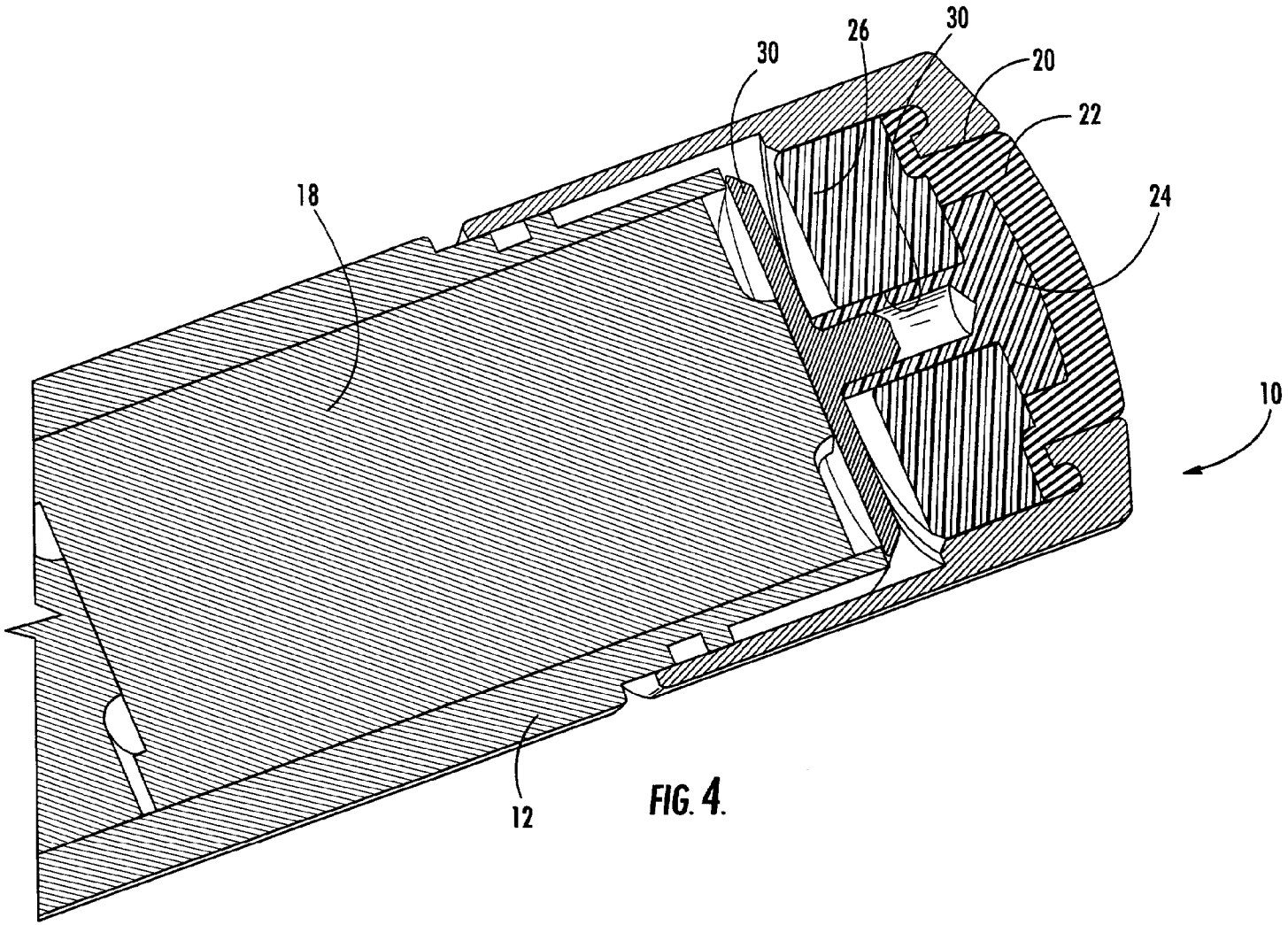
FIG. 4 is an enlarged cross-sectional view thereof in the momentary ON position.
Figure 5:
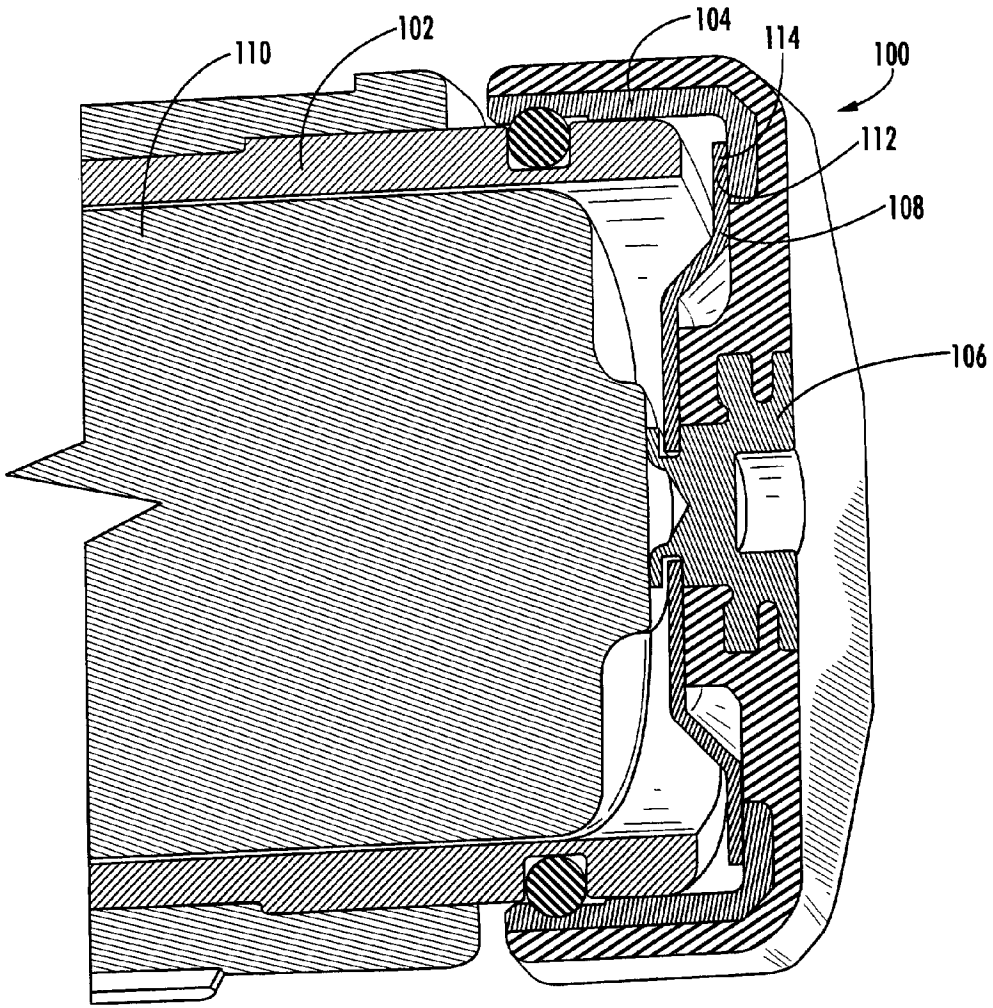
FIG. 5 is a cross-sectional view of an alternative embodiment thereof in the OFF position.
Figure 6:
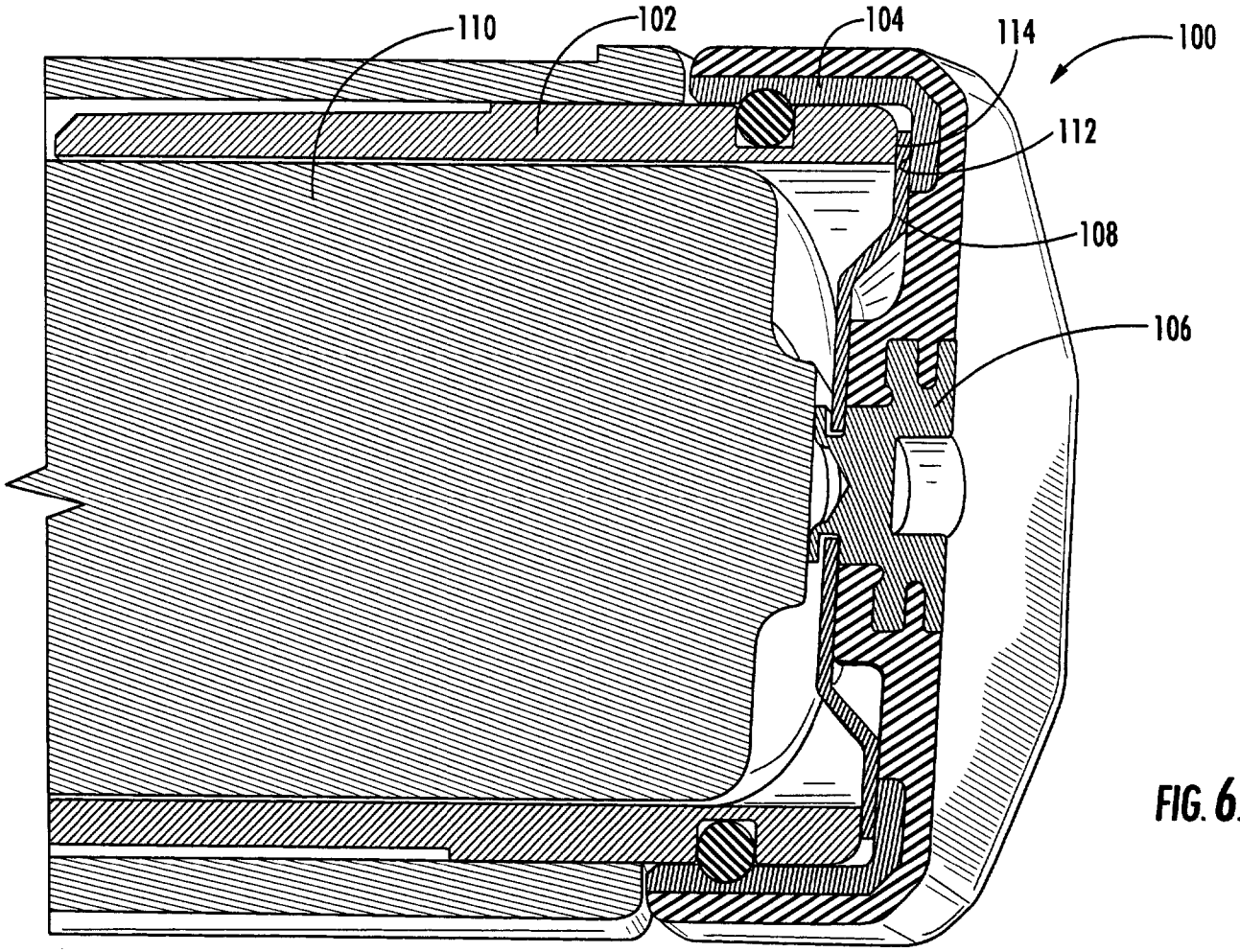
FIG. 6 is a cross-sectional view of the alternate embodiment in FIG. 5 in the ON position.

Referring now to the drawings, a flashlight including an end cap with the dual mode switch of the present invention is illustrated and generally indicated at 10 in FIGS. 1–4. Further, a second embodiment of the present invention is shown in FIGS. 5 and 6. In accordance with the present invention, an in-line flashlight is provided having a momentary ON, full ON and confirmable OFF position. The entire operational part of the switch component is incorporated into the end cap 10 of the flashlight battery housing 12.

Referring now to FIGS. 1–4, a pushbutton type switch is shown incorporated into the end 10 of a flashlight assembly. The flashlight has a battery housing 12 that is tubular in shape and is electrically conductive. An end cap 10 is threadedly received onto the end of the battery housing 12. A spring 14 is received into the battery housing 12 and is in electrical communication with one contact of a lighting element 16 located at the end of the battery housing 12 opposite the cap 10. The second contact of the lighting element 16 is in electrical communication with the interior wall of the battery housing 12. Batteries 18 are inserted into the battery housing 12 so that one end of the lower battery is in electrical communication with the spring 14. The cap 10 is threaded onto the battery housing 12 thereby retaining the batteries 18 between the spring 14 and the end cap assembly 10.

The end cap 10 further contains all of the operational elements of the switch mechanism of the present invention. The end cap 10 may or may not be constructed of electrically conductive material and includes an axial opening 20 on the end surface. An elastomeric sealing gasket 22 is seated in the end of the cap 10 covering the switch plunger 24 and waterproofing the switch assembly. The switch assembly is comprised of an insulating support disc 26, a plunger 24 slideably received through an axial bore 28 in the disc 26 and a switch plate 30. After the plunger 24 is inserted through the axial bore 28 in the disk 26, the switch plate 30 is affixed to the protruding end of the plunger 24. In this manner, once the plunger 24 and switch plate 30 are assembled, they can no longer be removed from the disk 26. When assembled, the switch plate 30 and plunger 24 are slideably movable within the axial bore 28. The insulator disk 26 is preferably a plastic material that is press fit into the cap 10 so that it remains in place when the flashlight is disassembled for servicing the batteries 18. The switch plunger 24 has a shaft and an enlarged head that is inserted through the axial bore 28 in the center of the insulator disk 26. The switch plate 30 is connected to the protruding end of the shaft of the plunger 24 either through the use of a fastener, an adhesive or through press fitting the switch plate 30 to the receiving end of the plunger 24. Once the end cap 10 is fully assembled, it can be seen that the travel, "T", of the switch assembly is limited to the distance between the enlarged head of the switch plunger 24 and the insulator disk 26. The end cap 10 is then threaded onto the end of the battery housing 12 wherein the threaded portion engages the threaded end of the battery housing 12.

In operation, it can be seen that the batteries 18 are spring biased by spring 14 in a direction towards the rear of the battery housing 12 and towards the end cap 10. The second contact of the batteries is in constant contact with the center of the switch plate 30. When the cap 10 is threaded onto the flashlight, it begins to press the batteries 18 downwardly into the battery housing 12. The batteries 18 further press upwardly causing the switch plate 30 to move into contact with the underside of the insulator disk 26. With the cap 10 only partially threaded onto the battery housing 12, it can be seen that if the distance, "D", between the electrically conductive battery housing 12 and the switch plate 30 is greater than the maximum travel distance of the switch assembly, the flashlight remains OFF and cannot be energized by pressing the switch because the gap "D" is too great to be overcome by the travel "T" of the switch. The limited travel of the switch is important in defining the function of the switch. In this position, the flashlight is in a confirmed OFF position. When the cap 10 is further threaded onto the battery housing 12 and the distance "D" between the switch plate 30 and the battery housing 12 is no longer greater than the travel "T" of the switch components, the switch can be depressed, pushing the batteries 18 downwardly, allowing the switch plate 30 to come into momentary contact with the battery housing 12 and momentarily energize the flashlight. If released, the batteries 18 push the switch plate 30 back breaking the contact between the battery housing 12 and the switch plate 30, thus providing a momentary ON function. Finally, if the cap 10 is fully threaded onto the battery housing 12, the switch plate 30 is pressed downwardly by the insulator disk 26 that is contacting its back side causing the switch plate 30 to be held in rigid contact with the battery housing 12 energizing the flashlight circuit in a full ON function.

Turning to FIGS. 5 and 6, a second embodiment of the present invention is shown. The operational concept of the switch is the same as described above. If the cap 100 is fully threaded onto the battery housing 102, the flashlight is energized in a full ON mode. If the cap 100 is partially unthreaded, pressing the center of the cap 100 activates the switch for a momentary ON mode. By further unthreading the cap 100 beyond the travel limit of the switch, a confirmed OFF position is reached. The mechanics of the switch elements in this embodiment, however, are different than those described above. The end cap 100 in this embodiment is formed from an elastomeric material and an annular metal ring 104. The metal ring 104 is integrally threaded and engages with corresponding threads on the end of the battery casing 102. The end cap 100 further includes a conductive center contact 106, integrally molded into the elastomeric cap 100. Rather than including a plunger to which the switch plate is connected, the switch plate 108 is fastened to the center contact 106 of the end cap 100. As described above, the battery 110 is spring biased against the center of the switch contact 106 and presses the switch plate 108 and cap center 106 normally away from the battery housing 102. In this regard, the upper surface 112 of the switch plate 108 includes a layer of electrical insulation. The insulation prevents an electrically conductive path from forming through the upper surface 112 of the switch plate 108 and the annular ring 104, which in turn is threaded onto the main battery housing 102. When the center of the elastomeric end cap 100 is pressed, it deflects inwardly causing the switch plate 108 to press the battery 110 downward and allowing the outer edge of the lower surface 114 of the switch plate 108 to contact the battery housing 102 thereby energizing the circuit. When released, the end cap 100 returns to its normal, non-deflected position pulling the switch plate 108 from the battery housing 102 and turning the flashlight off. If the end cap 100 is fully threaded onto the battery housing 102, the lower surface 114 of the switch plate 108 is held in contact with the battery housing 102 resulting in fully energizing the flashlight.

The present invention also anticipates that the push button switch may be employed as one component in the switching and function selection on a flashlight. For example, in addition to using the switch of the present invention, a flashlight may also incorporate electronics and a selector switch to further selectively energize the flashlight in a strobe or signal code manner. This also allows the end cap to be threaded on tightly under most operational circumstances. The end cap would then be unthreaded slightly to produce the momentary "on" function. Further, the switch of the present invention may be incorporated in parallel or series with other switching mechanism as have been described.

It can therefore be seen that the present invention provides a novel integrated in line dual mode switch assembly that enhances the function of a flashlight device. The switch assembly provides an the desirable ON, momentary ON and confirmable OFF features in a flashlight having a reduced number of operational parts, thereby enhancing the reliability of the flashlight while reducing the manufacturing costs associated therewith. Further, the present invention can be modified to accommodate a number of different flashlight configurations to create a highly useful and versatile switch assembly. For these reasons, the instant invention is believed to represent a significant advancement in the art, which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed:

1. A switch device for use in a flashlight comprising:

a housing having an electrical contact on a first end thereof and an outer wall defining an interior cavity;

at least one battery in said interior cavity, said battery being spring biased in a first linear direction towards said first end of said housing; and a switch assembly having a slidable actuator therein, said switch assembly threadedly received on said first end of said housing, said actuator being in electrical communication with said battery, said switch device having a fully closed position wherein said switch assembly is fully threaded onto said housing and said actuator is in electrical communication with said electrical contact, said switch device having a selectibly closed position wherein said switch assembly is partially unthreaded relative to said housing creating a space between said actuator and said electrical contact, said actuator being depressible in a second linear direction opposite said first causing said actuator to displace said battery and to move into electrical communication with said electrical contact and said switch device having a fully open position wherein further unthreading of said switch assembly relative to said housing causes said space between said actuator and said electrical contact to be greater than the allowable linear travel of said actuator preventing said actuator from contacting said electrical contact.

2. The switch device of claim 1, wherein said housing is electrically conductive.

3. The switch device of claim 1, said switch assembly further comprising:

an end cap threadedly received on said first end of said housing, said end cap having an annular opening therein;

an insulative disk having a first side, a second side and a central opening in the center thereof, said disk being received in said annular opening in said end cap;

an actuator having a head portion and a post extending from said head portion, said head portion further including a shoulder area adjacent to said post, said past of said actuator being slideably received in said central opening of said insulative disk, said post having a terminal end; and a contact plate, said contact plate being electrically conductive and having a first contact surface and a second surface opposite said first surface, said second surface being attached to said terminal end of said post, said contact plate in electrical communication with one terminal of said battery, said switch device having a fully closed position wherein said switch assembly is fully threaded onto said housing and said contact plate is in electrical communication with said electrical contact, said switch device having a selectibly closed position wherein said switch assembly is partially unthreaded relative to said housing creating a space between said contact plate and said electrical contact, said actuator being depressible in a second linear direction opposite said first, causing said switch actuator to move said contact plate into electrical communication with said electrical contact and said switch device having a fully open position wherein further unthreading of said end cap relative to said housing causes said space between said electrical contact and said contact surface to be greater than the space between said shoulder area of said actuator and said first side of said insulative disk, contact of said shoulder with said disk preventing said contact surface from contacting said electrical contact.

4. The switch device of claim 3, said switch assembly further comprising:

an elastomeric cover disposed in said end cap covering said actuator.

5. A switch device for use in a flashlight comprising:

a tubular housing having an electrically conductive outer wall, a first end and a second end, said outer wall defining an interior cavity;

at least one battery received in said interior cavity, said battery being spring biased in a first linear direction towards said first end of said housing;

an end cap threadedly received on said first end of said housing, said end cap having an annular opening therein;

an insulative support disk having a first side, a second side and a central opening in the center thereof, said support disk being received in said annular opening in said end cap;

an actuator having a head portion and a post extending from said head portion, said head portion further including a shoulder area adjacent to said post, said post of said actuator being slideably received in said central opening of said insulative support disk, said post having a terminal end; and a contact plate, said contact plate having a first contact surface and a second surface opposite said first surface, said second surface being attached to said terminal end of said post, said contact plate in electrical communication with one terminal of said battery.

said switch device having a fully closed position wherein said contact surface is in electrical communication with said first end of said housing when said end cap is fully threaded onto said housing, said switch device having a selectibly closed position wherein said end cap is partially unthreaded relative to said housing creating a space between said first end of said housing and said contact surface, said contact surface being urged into electrical communication with said first end of said housing by pressing said actuator in a second linear direction opposite said first and said switch device having a fully open position wherein further unthreading of said end cap relative to said housing causes said space between said first end of said housing and said contact surface to be greater than the space between said shoulder area of said actuator and said first side of said insulative disk, contact of said shoulder with said disk preventing said contact surface from contacting said housing.

6. The switch device of claim 4, said switch assembly further comprising:

an elastomeric cover disposed in said annular opening of said end cap, said elastomeric cover covering said actuator.

7. A flashlight assembly comprising:

a housing having an outer wall, a first end, a second end and an electrical contact on said first end thereof, said outer wall defining an interior cavity;

at least one battery in said interior cavity, said battery having a first contact and a second contact, said battery being spring biased in a first linear direction towards said first end of said housing;

a lighting element having first and second electrical contacts, said lighting element disposed in said second end of said housing, said first electrical contact in electrical communication with said electrical contact on said housing and said second electrical contact in electrical communication with said second contact of said battery; and a switch assembly having a slidable actuator therein, said switch assembly threadedly received on said first end of said housing, said actuator being in electrical communication with said first contact of said battery, said switch device having a fully closed position wherein said switch assembly is fully threaded onto said housing and said actuator is in electrical communication with said electrical contact thereby energizing said lighting element, said switch device having a selectibly closed position wherein said switch assembly is partially unthreaded relative to said housing creating a space between said actuator and said electrical contact, said actuator being depressible in a second linear direction opposite said first causing said actuator to move into electrical communication with said electrical contact selectively energizing said lighting element and said switch device having a fully open position wherein further unthreading of said switch assembly relative to said housing causes said space between said actuator and said electrical contact to be greater than the allowable linear travel of said actuator preventing said actuator from contacting said electrical contact.

8. The flashlight assembly of claim 7, wherein said housing is electrically conductive.

9. The flashlight assembly of claim 7, said switch assembly further comprising:

an end cap threadedly received on said first end of said housing, said end cap having an annular opening therein;

an insulative disk having a first side, a second side and a central opening in the center thereof, said disk being received in said annular opening in said end cap;

an actuator having a head portion and a post extending from said head portion, said head portion further including a shoulder area adjacent to said post, said post of said actuator being slideably received in said central opening of said insulative disk, said post having a terminal end; and a contact plate, said contact plate being electrically conductive and having a first contact surface and a second surface opposite said first surface, said second surface being attached to said terminal end of said post, said contact plate in electrical communication with one terminal of said battery, said switch device having a fully closed position wherein said switch assembly is fully Threaded onto said housing and said contact plate is in electrical communication with said electrical contact, said switch device having a selectibly closed position wherein said switch assembly is partially unthreaded relative to said housing creating a space between said contact plate and said electrical contact said actuator being depressible in a second linear direction opposite said first, causing said switch actuator to move said contact plate into electrical communication with said electrical contact and said switch device having a fully open position wherein further unthreading of said end cap relative to said housing causes said space between said electrical contact and said contact surface to be greater than the space between said shoulder area of said actuator and said first side of said insulative disk, contact of said shoulder with said disk preventing said contact surface from contacting said electrical contact.

10. The flashlight assembly of claim 9, said switch assembly further comprising:

an elastomeric cover disposed in said end cap covering said actuator.

11. The flashlight assembly of claim 7 wherein said lighting element is a light emitting diode.

12. The flashlight assembly of claim 7 wherein said lighting element is an array of light emitting diodes.

* * * * *